US005354493A

United States Patent [19]

Wilms

[11] Patent Number: 5,354,493

[45] Date of Patent: Oct. 11, 1994

[54] PROCESS FOR THE PRODUCTION OF SURFACTANT-CONTAINING GRANULATES

[75] Inventor: Elmar Wilms, Dormagen, Fed. Rep. of Germany

[73] Assignee: Henkel Kommanditgesellschaft auf Aktien, Duesseldorf, Fed. Rep. of Germany

[21] Appl. No.: 678,358

[22] PCT Filed: Oct. 12, 1989

[86] PCT No.: PCT/EP89/01206

§ 371 Date: Jun. 21, 1991

§ 102(e) Date: Jun. 21, 1991

[87] PCT Pub. No.: WO90/04629

PCT Pub. Date: Mar. 5, 1990

[30] Foreign Application Priority Data

Oct. 21, 1988 [DE] Fed. Rep. of Germany ..... 3835918

[51] Int. Cl.[5] ..... C11D 11/00; C11D 1/72; C11D 3/12

[52] U.S. Cl. ..... 252/174.21; 252/174; 252/174.22; 252/174.25; 252/DIG. 1

[58] Field of Search ..... 252/174.25, 174.21, 252/174.22, 174, DIG. 1

[56] References Cited

U.S. PATENT DOCUMENTS

| | | | |
|---|---|---|---|
| 2,874,123 | 2/1959 | Schaafsma et al. | 252/539 |
| 3,769,222 | 10/1973 | Yurko et al. | 252/89 |
| 3,915,878 | 10/1975 | Yurko et al. | 252/89 |
| 4,166,039 | 8/1979 | Wise | 252/110 |
| 4,169,075 | 9/1979 | Kuhling et al. | 252/558 |
| 4,239,640 | 10/1980 | Williams et al. | 252/95 |
| 4,321,157 | 3/1982 | Harris et al. | 252/174.25 |
| 4,707,290 | 11/1987 | Seiter et al. | 252/140 |
| 4,737,306 | 4/1988 | Wichelhaus et al. | 252/95 |
| 4,894,117 | 1/1990 | Bianchi et al. | 252/8.6 |
| 4,925,585 | 5/1990 | Strauss et al. | 252/89.1 |
| 4,970,017 | 11/1990 | Nakamura et al. | 252/174.13 |

FOREIGN PATENT DOCUMENTS

| | | |
|---|---|---|
| 0026529 | 4/1981 | European Pat. Off. . |
| 0028432 | 5/1981 | European Pat. Off. . |
| 0149264 | 7/1985 | European Pat. Off. . |
| 2334899 | 1/1974 | Fed. Rep. of Germany . |
| 2527388 | 4/1976 | Fed. Rep. of Germany . |
| 2837504 | 3/1980 | Fed. Rep. of Germany . |
| 3206265 | 11/1982 | Fed. Rep. of Germany . |
| 3444960 | 6/1986 | Fed. Rep. of Germany . |
| 3526405 | 2/1987 | Fed. Rep. of Germany . |
| 2369341 | 11/1977 | France . |

*Primary Examiner*—Paul Lieberman
*Assistant Examiner*—A. Hertzog
*Attorney, Agent, or Firm*—Ernest G. Szoke; Wayne C. Jaeschke; Real J. Grandmaison

[57] ABSTRACT

Free-flowing granulates having an apparent density of 650 to 1,000 g/l and containing nonionic surfactants from the class of polyglycol ether derivatives and also finely divided, water-soluble and/or water-insoluble solids and water are prepared by mixing the nonionic surfactant with water, which may optionally contain part, but less than 50% by weight, of the total quantity of water-soluble or water-insoluble solids in dissolved or dispersed form, in a first mixing step (A) until a viscous gel phase has formed. The remaining main quantity of the water-soluble or water-insoluble solids are then added and mixed in solid, powder form in a second mixing phase (B) and the mixture is mechanically treated until granulates have formed and a maximum apparent density is reached. The ratio by weight of nonionic surfactant and water in the gel phase to total solids present (expressed as anhydrous substance) is from 25:75 to 65:35. Zeolites and bentonites are particularly suitable as the water-insoluble solids.

21 Claims, No Drawings

PROCESS FOR THE PRODUCTION OF SURFACTANT-CONTAINING GRANULATES

This invention relates to a process for the production of granulates which, despite their high content of nonionic surfactants and adsorbed water, are free-flowing and have a high apparent density and a very homogeneous grain spectrum. The granulates may be obtained by a comparatively simple mixing process and do not have to be dried. They may be directly used as detergents or cleaning preparations or as an additional powder component in made-up detergents and cleaning preparations.

Granulates containing carrier substances and liquid or paste-form nonionic surfactants adsorbed thereon are known. Processes have been developed for their production in which the liquid or molten nonionic surfactant is sprayed onto a previously spray-dried powder or is mixed under granulating conditions with a powder-form carrier substance. Carrier substances which have been proposed include loose, more especially spray-dried, water-soluble salts, such as phosphates, silicates, borates and perborates, or salt mixtures prepared in a certain way beforehand, for example of sodium triphosphate and sodium silicate or of sodium carbonate and sodium bicarbonate, and also water-insoluble compounds, for example zeolites, bentonites and silicon dioxide (Aerosil), and also mixtures of the above-mentioned substances. Mixtures of water-soluble and water-insoluble carrier materials have also been used. DE 32 06 265 describes phosphate-free carrier grains consisting of 25 to 52% sodium carbonate or hydrogen carbonate, 10 to 50% zeolite, 0 to 18% sodium carbonate and 1 to 20% bentonite or 0.05 to 2% polyacrylate. DE 34 44 960-A1 describes a granular adsorbent which is capable of taking up large amounts of liquid to paste-form detergent ingredients, more especially nonionic surfactants, and contains (based on anhydrous substance) 60 to 80% by weight zeolite, 0.1 to 8% by weight sodium silicate, 3 to 15% by weight homopolymers or copolymers of acrylic acid, methacrylic acid and/or maleic acid, 8 to 18% by weight water and, optionally, up to 5% by weight nonionic surfactants and is obtainable by spray drying. According to EP 149 264, commercially available spray-dried zeolites and mixtures thereof with inorganic salts, such as sodium sulfate, may be used for the same purpose, the grain size and apparent density of these spray-dried products lying in the usual ranges.

All these processes are comparatively expensive because, first, an aqueous slurry of the carrier substance has to be prepared and then converted by spray-drying, i.e. with high energy consumption, into a granular, porous intermediate product. The second stage of the process, in which the carrier grains are sprayed with the nonionic surfactant, is also expensive on apparatus and time-consuming, especially since the nonionic surfactant diffuses in with delay and adsorbates containing a high level of nonionic surfactants are only adequately free-flowing after a certain treatment time and rest time. If, by contrast, powder-form intermediate products, for example finely crystalline zeolites, or crystalline, water-soluble carrier salts, are used as starting materials and treated with liquid or molten nonionic surfactants under granulating conditions, i.e. with bonding and cementing of the powder particles to relatively large granulates, the granulates obtained in this way have a very irregular grain spectrum and reduced flow properties. In addition, the absorption capacity of granulates such as these for nonionic surfactants is considerably lower than that of sprayed carrier grains.

One known property of nonionic surfactants (NS) of the polyglycol ether derivative type is that they form highly viscous gels when mixed with water in a ratio of NS to water of approximately 5:1 to 1:2. Gels such as these are formed, for example, when nonionic surfactants are incorporated in the detergent slurry before spray drying. They lead to a considerable increase in viscosity and are thus a burden on the spray-drying process because water has to be additionally added to reduce viscosity and then removed again by evaporation in the subsequent drying process which involves more work. The gels are also formed when detergent pastes containing high levels of nonionic surfactants are dissolved in the wash liquor. Depending on the composition of the paste, viscous, slimy lumps can be formed and only dissolve very slowly or, if they sink to the bottom, do not dissolve at all in the wash liquor. They can also be formed on the surface of detergent particles with nonionic surfactants adsorbed thereon, for example on the above-mentioned carrier grains when these carrier grains or mixtures thereof with other detergents are dissolved in water. The gels adversely affect the dispensing behavior of the detergents, i.e. considerable quantities of detergent can remain behind undissolved in the dispensing compartments of washing machines. Accordingly, the tendency of nonionic surfactants to form gels is regarded as undesirable among experts so that efforts are being concentrated on preventing their formation both during detergent manufacture and in practical applications.

Accordingly, it was extremely surprising to find that the formation of such gels can be utilized with advantage to produce detergent granulates having a number of excellent properties in a particularly simple manner.

The present invention relates to a process for the production of free-flowing granulates of high apparent density containing nonionic surfactants from the class of polyglycol ether derivatives, finely divided, water-soluble and/or water-insoluble solids and water, characterized in that (A) the nonionic surfactant is mixed with water, which may optionally contain part, but less than 50% by weight, of the total quantity of water-soluble or water-insoluble solids in dissolved or dispersed form, until a viscous gel phase is formed, after- Which (B) the remaining main quantity of water-soluble or water-insoluble solids is added in powder form and the resulting mixture is mechanically treated until granulates are formed, the ratio by weight of nonionic surfactant and water in the gel phase to the total solids present (expressed as anhydrous substance) being from 25:75 to 65:35.

The ratio by weight of nonionic surfactant and water in the gel phase to total solids present (expressed as anhydrous substance) is preferably from 30:70 to 60:40. In general, from 0 to 40% by weight, preferably from 0 to 30% by weight and more preferably from 5 to 25% by weight of the total solids present are used in the form of an aqueous solution and/or aqueous dispersion in the formation of the gel phase (A) and the remaining main quantity is added as a dry powder and granulated in the granulation phase (B).

Suitable nonionic surfactants (part of the gel phase A) according to the invention are alkoxylation products containing 10 to 20 carbon atoms in the hydrophobic part and 3 to 20 glycol ether groups. Alkoxylation products such as these include ethoxylation products of alcohols, vicinal diols, amines, thioalcohols, fatty acid amides and fatty acids. Alkyl phenol polyglycol ethers containing 5 to 12 carbon atoms in the alkyl radical and 3 to 15 ethylene glycol ether groups are also suitable. The ethoxylates mentioned may also contain glycol ether groups derived from propylene oxide, for example as block groups or in statistical distribution. Finally, block polymers of ethylene oxide and propylene oxide commercially available as Pluronics are also suitable.

Liquid to paste-form nonionic surfactants derived from $C_{12-18}$ alcohols are preferred. These alcohols may be saturated or olefinically unsaturated and linear or methyl-branched in the 2-position (oxo radical). Examples of alcohols such as these are $C_{12-18}$ coconut alcohol containing 3 to 12 EO, $C_{16-18}$ tallow alcohol containing 4 to 16 EO, oleyl alcohol containing 4 to 12 EO and ethoxylation products of the same chain and EO distribution obtainable from other native fatty alcohol mixtures. From the group of ethoxylated oxo alcohols, those having the composition $C_{12-15}$+3 to 10 EO and $C_{14-15}$+5 to 12 EO for example are suitable. Mixtures of alcohols having low and high degrees of ethoxylation, for example mixtures of tallow alcohol+3 to 6 EO and tallow alcohol+12 to 16 EO or $C_{13-15}$ oxo alcohol+3 to 5 EO and $C_{12-14}$ oxo alcohol+8 to 12 EO, are distinguished by high detergency both with respect to greasy soil and with respect to mineral soil. Other suitable ethoxylates are those containing EO groups and PO groups, for example $C_{12-18}$ alcohols corresponding to the formula $R—(PO)_a—(EO)_b$ or $R—(EO)_b—(PO)_c$, in which a is a number of 1 to 3, b is a number of 3 to 20 and c is a number of 1 to 10 (b greater than a and c).

Preferred solids are water-insoluble compounds and mixtures thereof with water-soluble salts. In another preferred version, at least 50% by weight of the solids consist of finely divided water-insoluble solids.

Suitable finely divided, water-insoluble solids (part of the granulation phase B and, optionally, of the gel phase A) are silica and silicates, preferably zeolites and layer silicates (bentonites) and mixtures thereof. Their grain size is preferably below 100 μm and more preferably below 50 μm.

Suitable zeolites are those of the zeolite A type. It is also possible to use mixtures of zeolite NaA and NaX, the content of zeolite NaX in mixtures such as these best being below 30% and more especially below 20%. Suitable zeolites contain no particles larger than 30 μm in size and consist to a level of at least 80% of particles smaller than 10 μm in size. Their average particle size (volume distribution, method: Coulter Counter) is from 1 to 10 μm. Their calcium binding power, as determined in accordance with DE 24 12 837, is in the range from 100 to 200 mg CaO/g.

Suitable layer silicates are those of natural and synthetic origin which are known, for example, from DE 23 34 899 B2, EP 26 529 A1 and DE 35 26 405 A1. Their suitability as a carrier material is not confined to a particular composition or structural formula.

Suitable water-soluble salts, which may preferably be used together with the finely divided water-insoluble solids mentioned above, are primarily builder salts which contain polyanionic groups or have a tendency to form associated polyanionic groups, such as alkali metal silicates, more especially sodium silicate having the composition $Na_2O:SiO_2$=1:1 to 1:3.4 and preferably 1:2 to 1:3.3, alkali metal phosphates and polyphosphates, more especially pentasodium triphosphate, borates, such as sodium metaborate and sodium tetraborate. Other suitable representatives of this class are the salts of organic polyacids or polymeric acids, such as sodium nitrilo-triacetate, sodium citrate, sodium carboxymethyl cellulose, sodium polyacrylate and also the sodium salts of copolymers of acrylic acid and maleic acid. In aqueous solution, salts such as these generally produce a very pronounced increase in viscosity with increasing concentration. They are preferably used together with water-insoluble solids. In this case, their content, based on total solids present, may be up to 50% by weight and is preferably up to 35% by weight.

Together with the water-insoluble solids, water-soluble salts which may be characterized as strongly polar, have a substantially monoanionic or dianionic structure and, in aqueous solution, produce only a slight increase in viscosity with increasing concentration may also be used either in conjunction with or instead of the polyanionic salts mentioned above. Typical representatives of this class are sodium sulfate, sodium carbonate, sodium acetate, sodium nitrate and sodium chloride and also corresponding potassium salts. However, their content, based on total solids present, may be at most 35% by weight and is preferably at most 25% by weight and, more preferably, less than 20% by weight. Under no circumstances may they be the sole constituent or main constituent of the solid component, nor may they be used in the absence of a water-insoluble solid because this would result in destruction of the gel phase and in the formation of sludge-like to lumpy mixtures. Liquefied mixtures or moist lumps such as these cannot be converted into granulates by simple mechanical treatment. For the same reason, it is of advantage to mix these salts, where their use cannot be avoided, beforehand with the powder-form, water-insoluble solids in the production of the granulates or to add them to the gel phase simultaneously with these solids or even as the last constituent of the mixture after all other solids have been added.

Finally, small quantities of anionic, zwitterionic, ampholytic or cationic surfactants may be added as solids to the gel phase. Examples of suitable anionic surfactants are soaps derived from saturated or monounsaturated $C_{12-22}$ fatty acids, alkyl benzene sulfonates containing a linear $C_{9-13}$ alkyl group, salts of α-sulfofatty acids derived from saturated or monounsaturated $C_{12-18}$ fatty acids and esters thereof with saturated $C_{1-3}$ alcohols, $C_{12-18}$ alkane sulfonates, $C_{12-18}$ olefin sulfonates and $C_{12-18}$ alkyl sulfates or alkyl ether sulfates, the surfactants mentioned preferably being present as Na salts. The content of these surfactants, preferably sulfonate surfactants, may be up to 25% by weight and is preferably up to 15% by weight, based on the solids. Based on nonionic surfactants present in the gel phase, the ratio by weight of nonionic surfactant to anionic surfactant should not be below 3:2 and is preferably not below 2:1. Larger proportions of anionic surfactants can adversely affect formation of the gel phase and can prevent conversion of the gel phase into granular, free-flowing granulates.

Finally, other solids of the type typically present in small quantities in detergents and cleaning preparations may be incorporated in the gel phase (A) or added in the granulation phase (B), including for example optical brighteners, redeposition inhibitors, complexing agents, dyes, pigments, enzymes, foam inhibitors and perfumes. Their content is generally below 1% by weight, so that they do not adversely affect conversion of the gel phase into the granulate.

The nonionic surfactant is best not mixed solely with water in the preparation of the gel phase, although this is basically possible, instead it is preferred to use an aqueous solution or dispersion already containing part of the total solids or solid mixtures to be used. Where zeolite is used as the solid, the gel phase is preferably prepared from a stabilized aqueous dispersion (master batch) of the type described, for example, in DE 25 27 388. Dispersions such as these, which accumulate as water-moist filter cakes in the zeolite synthesis process, typically contain from 35 to 55% by weight and preferably from 40 to 50% by weight zeolite, expressed as anhydrous active substance (i.e. freed from water at the calcination temperature), from 0.5 to 5% by weight and preferably from 1 to 4% by weight of a dispersion stabilizer, more especially a nonionic surfactant, and 64.5 to about 40% by weight of water (balance to 100%). Similarly, aqueous solutions of alkali silicates, for example waterglass solutions, aqueous solutions of anionic surfactants or even mixtures of such solutions may be used instead of, at the same time as or in admixture with the aqueous zeolite dispersion for the formation of the gel phase.

The granulates may be produced in standard mixing and granulation units, for example in cylindrical mixers arranged horizontally or inclined to the horizontal with an axial rotatable shaft on which stirring and mixing elements are arranged. The nonionic surfactant may be initially introduced and the water or an aqueous solids mixture added and the whole mixed until gelation occurs or even vice versa. The dry, powder-form solids component is then added to the gel formed with continued mixing, mixing then being continued until the desired granulate has formed. Since gelation of the gel phase (A) often takes some time, for example 10 to 30 seconds, to reach the maximum viscosity, it is also possible in many cases initially to introduce the powder-form solids component into the mixer and then to add the still free-flowing gel phase prepared immediately beforehand and again to continue mixing until free-flowing granulates have formed. The variants mentioned may be carried out both discontinuously and also continuously. In the discontinuous procedure, it is basically possible and preferred to add the solids all at once and not in portions over a prolonged period, thereby simplifying the procedure.

Mixing and granulation may be carried out at room temperature, for example at 15° to 30° C. There is no need for heating or cooling during processing.

Formation of the granulates is spontaneous and does not require any special measures apart from stirring or mixing. The time which the uniform granulates take to form depends to a certain extent on the total quantity of solids, but especially on the amount of powder-form solids added, being from 30 seconds to 3 minutes for solids additions of 35 to 50% by weight, based on the final granulate. The granulation time increases exponentially with increasing solids addition and is from 10 to 15 minutes for solids additions of 65 to 75% by weight. In general, larger solids additions than 75% by weight are not necessary and, in many cases, are also inappropriate. In addition, it is neither necessary nor of any advantage to continue mixing after the formation of uniform, free-flowing granulates because it has been found that, particularly with low-solids mixtures, the formation of the granulates passes through an optimum in regard to their flow behavior and uniformity. Thereafter, further mechanical treatment results in softening of the already formed granules and in lumping and adhesion to the mixing tools accompanied by a distinct reduction in flow and apparent density.

In practice, granulation is best continued until the apparent density of the granulate has reached a maximum. This maximum is also characterized by optimal grain structure and flow and may optionally be determined by a simple preliminary test. This state is visually discernible without difficulty because the granulates appear particularly uniform and flow freely in the mixer and also because no more material adheres to the walls of the mixer or to the mixing tools. At the same time, this state may be characterized by a minimal power demand for operating the mixer and may readily be determined in this way also.

In the region of the optimum, the granulates may be completely removed from the mixer and cleared from the outflow opening. The inner walls of the emptied mixer and the mixing tools are generally bare thereafter. This effect is extremely surprising, particularly recalling the initial stage when the gel adheres to the tools and to the mixer shaft as a viscous, paste-like or lumpy mass.

Despite their high content of liquid constituents, for example more than 50% of water and liquid nonionic surfactants, the granulates prepared as described above show excellent flow behavior and generally do not require any aftertreatment or drying. Where the granulates are required to have a low water content, for example when they are to be mixed with moisture-sensitive constituents or powder mixtures, they may also be dried, for example in a fluidized-bed dryer. In this case, there is no need for heated air to be used. In addition, the granulates accumulating or even the dried granulates may also be dusted or coated with other powder-form constituents, such as finely divided silica or pigments (including colored pigments). They have apparent densities in the range from 600 to 1,000 g/l and preferably in the range from 650 to 900 g/l and are eminently suitable as a basic constituent of or additional powder component in detergents of the so-called "heavy" powder type. These heavy powders are acquiring increasing interest because they take up far less packing space than conventional spray-dried powders and save packaging material for the same detergent performance. Irrespective of their high density, the granulates show excellent dissolving power in cold tapwater and are distinguished by good "dispensing" behavior, i.e. they do not leave any residues behind in the dispensing compartments of automatic washing machines.

The process affords further advantages in that it enables substances which lose their effectiveness or interact with other substances during spray drying to be carefully processed. The decomposable substances or substances which lose their effectiveness include enzymes, bleaches, bleach activators, foam inhibitors and perfumes. Mixtures of zeolite and alkali silicate, which react during spray drying to form coarse agglomerates that are difficult to redisperse, may readily be processed together without any of these disadvantages. Even nonionic surfactants having a low degree of ethoxylation, which lead to pluming in the exhaust air of the spray-drying towers on account of their volatility in steam, may be used without any problems in the process according to the invention.

EXAMPLES

Both a laboratory mixer having a holding capacity of 2 liters and a mixer having a holding capacity of 135 liters (Lödige type) were used in the following Examples. Both mixers consisted of a cylindrical, horizontally arranged container with an axially arranged shaft equipped with mixing blades. The rotational speed of the laboratory mixer was 300 r.p.m and the rotational speed of the large mixer 120 r.p.m. There were no significant differences between the two series of tests in regard to the mode of operation, the granulation time and the properties of the granulates. In the following Examples, "pbw" stands for parts by weight and "sec" for seconds.

1. In the laboratory mixer, 30 pbw of an aqueous zeolite dispersion containing 15 pbw zeolite (anhydrous), 0.5 pbw ethoxylated tallow alcohol (5 EO groups) as dispersion stabilizer and 14.5 pbw water were mixed with 20 pbw of an ethoxylated $C_{12-18}$ fatty alcohol+5 EO (coconut-tallow alcohol 1:4). A gel phase was formed over a period of 20 to 30 sec. 50 pbw of a spray-dried zeolite (water content 21% by weight) were added to this gel with continued mixing. Granulate formation began spontaneously after a mixing time of approximately 20 sec. The increase in apparent density (in g/l) as a function of the granulation time in seconds after addition of the dry zeolite was as follows:

| sec | 20 | 30 | 40 | 50 | 60 | 70 | 80 | 100 |
|---|---|---|---|---|---|---|---|---|
| g/l | 650 | 730 | 790 | 835 | 875 | 900 | 900 | 840 |

After only 50 sec, the granulates were free-flowing. Up to a mixing time of 70 sec, i.e. up to the point at which maximum apparent density was reached, there was an even further increase in flowability. After longer mixing, softening and lumping of the granulates occurred, accompanied by a reduction in apparent density and an increase in the energy demand of the mixer.

The granulates obtained after mixing times of 60 sec had the following grain spectrum as determined by screen analysis. The fractions remaining on a sieve of the stated mesh width and those passing through the sieve at "under 0.1" are shown.

| mm | 1.6 | 0.8 | 0.4 | 0.2 | 0.1 | under 0.1 |
|---|---|---|---|---|---|---|
| % by wt. | 3 | 32 | 38 | 24 | 2 | 1 |

The lump test (application of a weight to a pile of powder in a cylindrical container) produced the optimal value 0. The mixer showed no adhering residues and could be recharged without preliminary cleaning.

2. In the same way as described in Example 1, 10 pbw of the same nonionic surfactant were mixed with 40 pbw of the zeolite dispersion with gel formation. 50 pbw finely powdered bentonite were then added. The granulate obtained after a granulation time of 50 sec had an apparent density of 660 g/l.

3. 20 pbw of an oleyl-stearyl alcohol mixture (iodine value=50) reacted with 5 mol EO were mixed with 30 pbw of the aqueous zeolite dispersion with gel formation. The granulate produced in 50 sec with addition of 50 pbw spray-dried zeolite had an apparent density of 840 g/l.

4. 20 pbw $C_{12-14}$ fatty alcohol+3 EO were mixed with 30 pbw aqueous zeolite dispersion to form a gel, followed by the addition of 50 pbw spray-dried zeolite. The granulate obtained after a granulation time of 50 sec had an apparent density of 820 g/l.

5. 18 pbw of the fatty alcohol ethoxylate used in Example 1 and 27 pbw zeolite dispersion were mixed to form a gel. After addition of 45 pbw spray-dried zeolite and 10 pbw calcined soda and a granulation time of 60 sec, a free-flowing granulate having an apparent density of 800 g/l was obtained.

6. A gel obtained by mixing of 20 pbw of the fatty alcohol ethoxylate used in Example 1, 20 pbw aqueous zeolite dispersion and 10 pbw of a waterglass solution ($Na_2O:SiO_2=1:3.3$, water content 65.5% by weight) was granulated in 60 sec with addition of 50 pbw spray-dried zeolite. The free-flowing granulates which disintegrated rapidly in water with no sign of agglomeration had an apparent density of 850 g/l.

7. A gel was prepared from 12 pbw of the fatty alcohol ethoxylate of Example 1 and 20 pbw of an aqueous surfactant suspension containing 31% by weight of a mixture of α-sulfofatty acid methyl ester (Na salt) and α-sulfofatty acid (di-Na salt). of saturated $C_{6-18}$ fatty acids (mixing ratio of mono-Na salt to di-Na salt 4:1). After addition of 68 pbw spray-dried zeolite and granulation (50 sec), a free-flowing granulate having an apparent density of 810 g/l was obtained.

8. Example 1 was repeated in a granulation mixer (Lödige-Mischer®) with a holding capacity of 135 liters was repeated by first filling the mixer with the spray-dried zeolite powder. The fatty alcohol ethoxylate was premixed with the aqueous zeolite dispersion in another mixing vessel and the gel formed was transferred to the granulation mixer in 10–15 sec in the still fluid state. After a mixing and granulation time of 70 sec, a homogeneous, free-flowing granulate having an apparent density of 900 g/l was obtained and corresponded in its other grain properties to the granulate of Example 1.

I claim:

1. A process for the production of free flowing granulates having a high apparent density containing a nonionic surfactant selected from the group consisting of polyglycol ether derivatives, a finely-divided solid at least 65% by weight of which is water-insoluble, and water, consisting essentially of (a) mixing said nonionic surfactant with water until a viscous gel phase is formed, and (b) thereafter adding to said gel phase said solid in powder form and mixing the resulting mixture at room temperature until granulates are formed, wherein the ratio by weight of said nonionic surfactant and said water in the gel phase to said solid, as anhydrous substance, is from about 25:75 to about 65:35.

2. A process as in claim 1 wherein the ratio by weight of said nonionic surfactant and said water in the gel phase to said solid, as anhydrous substance, is from about 30:70 to about 60:40.

3. A process as in claim 1 including in step (a) adding from 0 to about 40% by weight of said solid during the formation of said gel phase, and adding the remaining quantity of solid during step (b).

4. A process as in claim 1 including in step (a) adding from about 5 to about 25% by weight of said solid during the formation of said gel phase, and adding the remaining quantity of solid during step (b).

5. A process as in claim 1 wherein said solid has a particle size of less than about 100 μm.

6. A process as in claim 1 wherein said solid is selected from the group consisting of crystalline zeolite, bentonite and mixtures thereof.

7. A process as in claim 1 wherein said gel phase is mixed with said solid until the apparent density of said granulates formed has reached a maximum value.

8. A process as in claim 1 wherein in step (a) said nonionic surfactant is mixed with an aqueous dispersion of crystalline zeolite to form said gel phase, said aqueous dispersion containing from about 35 to about 55% by weight of zeolite as anhydrous substance, about 0.5 to about 5% by weight of an additional nonionic surfactant as a dispersion stabilizer, and about 64.5 to about 40% by weight of water.

9. A granulate composition produced by the process of claim 1.

10. A granulate composition produced by the process of claim 3.

11. A granulate composition produced by the process of claim 1 having an apparent density of from about 600 to about 1,000 g./l.

12. A process for the production of free-flowing granulates having a high apparent density containing a nonionic surfactant selected from the group consisting of polyglycol ether derivatives, a finely-divided solid at least 65% by weight of which is water-insoluble, and water, consisting essentially of (a) mixing said nonionic surfactant with water containing up to about 50% by weight of the total quantity of said solid until a viscous gel phase is formed, and (b) thereafter adding to said gel phase the remaining quantity of said solid in powder form and mixing the resulting mixture at room temperature until granulates are formed, wherein the ratio by weight of said nonionic surfactant and said water in the gel phase to said solid, as anhydrous substance, is from about 25:75 to about 65:35.

13. A process as in claim 12 wherein the ratio by weight of said nonionic surfactant and said water in the gel phase to said solid, as anhydrous substance, is from about 30:70 to about 60:40.

14. A process as in claim 12 wherein said solid has a particle size of less than about 100 μm.

15. A process as in claim 12 wherein said solid is selected from the group consisting of crystalline zeolite, bentonite and mixtures thereof.

16. A process as in claim 12 wherein said gel phase is mixed with said solid until the apparent density of said granulates formed has reached a maximum value.

17. A process as in claim 12 wherein in step (a) said nonionic surfactant is mixed with an aqueous dispersion of crystalline zeolite to form said gel phase, said aqueous dispersion containing from about 35 to about 55% by weight of zeolite as anhydrous substance, about 0.5 to about 5% by weight of an addiitonal nonionic surfactant as a dispersion stabilizer, and about 64.5 to about 40% by weight of water.

18. A granulate composition produced by the process of claim 12.

19. A granulate composition produced by the process of claim 17.

20. A granulate composition produced by the process of claim 12 having an apparent density of from about 600 to about 1,000 g./l.

21. A granulate detergent composition containing the granulate composition of claim 18.

* * * * *